US010215377B2

(12) United States Patent
Laurendet

(10) Patent No.: US 10,215,377 B2
(45) Date of Patent: Feb. 26, 2019

(54) LIGHT ASSEMBLY AND A METHOD OF SECURING THE LIGHT ASSEMBLY INTO AN OPENING IN A THIN WALL

(71) Applicant: James Anthony Laurendet, Hazelbrook (AU)

(72) Inventor: James Anthony Laurendet, Hazelbrook (AU)

(73) Assignee: KLIK SYSTEMS LTD PTY, Eastern Creek, NSW (AU)

( * ) Notice: Subject to any disclaimer, the term of this patent is extended or adjusted under 35 U.S.C. 154(b) by 0 days.

(21) Appl. No.: 15/899,462

(22) Filed: Feb. 20, 2018

(65) Prior Publication Data

US 2018/0238524 A1 Aug. 23, 2018

Related U.S. Application Data

(60) Provisional application No. 62/460,994, filed on Feb. 20, 2017.

(51) Int. Cl.

| | |
|---|---|
| ***F21V 19/00*** | (2006.01) |
| ***F21V 21/04*** | (2006.01) |
| *F21S 8/02* | (2006.01) |
| *F21V 23/06* | (2006.01) |
| *F21Y 115/10* | (2016.01) |

(52) U.S. Cl.

CPC ..... *F21V 19/007* (2013.01); *F21V 19/0015* (2013.01); *F21V 19/0065* (2013.01); *F21V 21/043* (2013.01); *F21S 8/024* (2013.01); *F21S 8/026* (2013.01); *F21V 23/06* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2013/0122724 | A1* | 5/2013 | Velazquez | F21S 2/00 439/39 |
| 2013/0163254 | A1* | 6/2013 | Chang | F21V 29/004 362/294 |
| 2016/0254623 | A1* | 9/2016 | Creusen | F21V 23/06 439/366 |
| 2018/0219341 | A1* | 8/2018 | Blair | F21V 23/02 |

* cited by examiner

*Primary Examiner* — Sharon E Payne

(74) *Attorney, Agent, or Firm* — James Earl Lowe, Jr.

(57) ABSTRACT

A light assembly including a light having a body with a ramp and a threaded opening. The body also has one end and another end having an outwardly extending flange, an elongated light central axis, and an outer surface having the ramp closer to the elongated light central axis at the one end of the light. The ramp is further away from the elongated light central axis near the other end. The light assembly also includes a lock piece having an end, and the lock piece is positioned on the body for movement along the ramp away from the one end, so that the lock piece end moves further away from the elongated central axis as the lock piece moves along the ramp away from the one end. The light assembly also includes a like threaded stem having an elongated axis and received in the threaded opening in the light, the stem being connected to the lock piece so that, as the threaded stem rotates about its elongated axis in the threaded opening, moving away from the light one end, the stem moves the lock piece away from the one end.

5 Claims, 6 Drawing Sheets

LIGHT ASSEMBLY AND A METHOD OF SECURING THE LIGHT ASSEMBLY INTO AN OPENING IN A THIN WALL

FIELD OF INVENTION

This disclosure is directed to a light assembly and a method of securing the light assembly into an opening in a thin wall accessible from one side, but inaccessible from an opposite side. The thin wall can be part of a tube, or it can be a ceiling or a wall, for example.

BACKGROUND OF THE INVENTION

When securing a light assembly into an opening in a thin wall accessible from one side, but inaccessible from an opposite side, various methods of doing so have been proposed. None of the proposed solutions however provide an adequate process for adding a light figure into an inaccessible enclosure in a direct and simple fashion.

SUMMARY OF THE INVENTION

Disclosed is a light assembly including a light having a body with a ramp and a threaded opening. The body also has one end and another end having an outwardly extending flange, an elongated light central axis, and an outer surface having the ramp closer to the elongated light central axis at the one end of the light. The ramp is further away from the elongated light central axis near the other end. The light assembly also includes a lock piece having an end, and the lock piece is positioned on the body for movement along the ramp away from the one end, so that the lock piece end moves further away from the elongated central axis as the lock piece moves along the ramp away from the one end. The light assembly also includes a like threaded stem having an elongated axis and received in the threaded opening in the light, the stem being connected to the lock piece so that, as the threaded stem rotates about its elongated axis in the threaded opening, moving away from the light one end, the stem moves the lock piece away from the one end.

Figure 1:
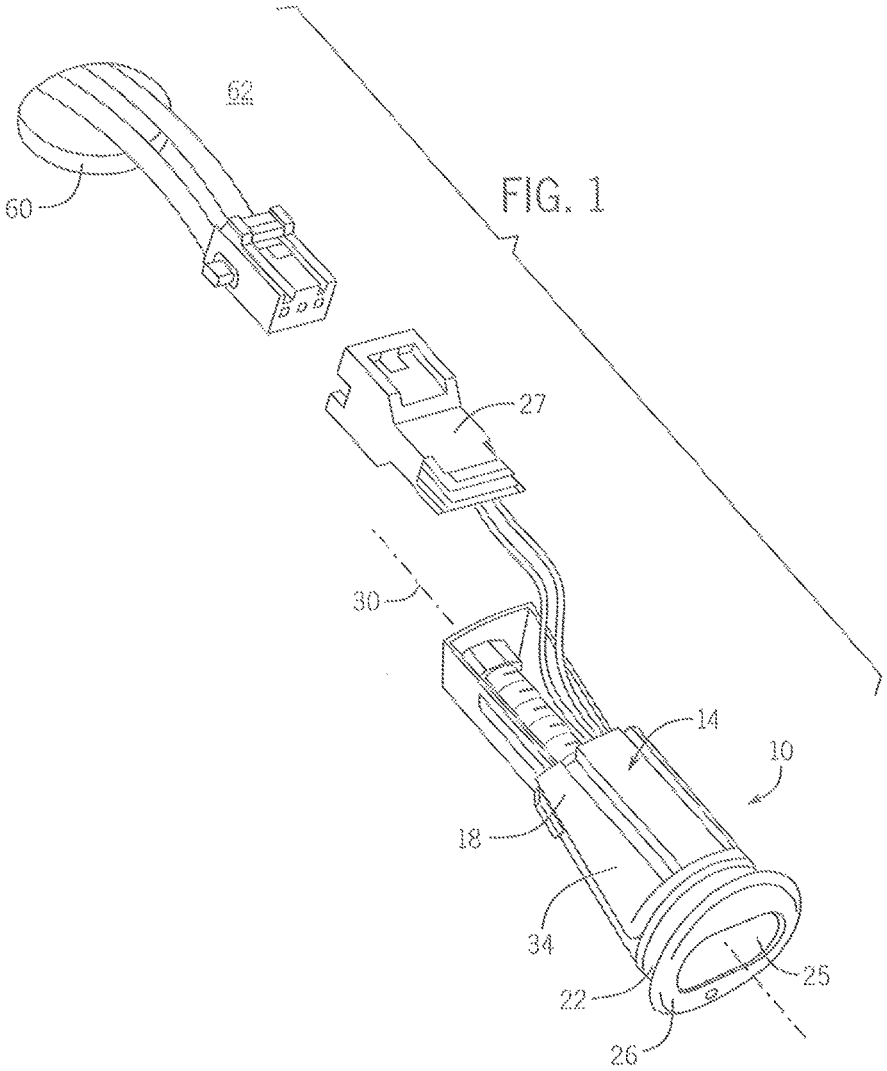
FIG. 1 is a side perspective view of a light assembly being inserted into an opening in a tube.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DETAILED DESCRIPTION

As illustrated in FIGS. 1-5, disclosed is a light assembly 10 and a method of securing the light assembly 10 into an opening 60 in a thin wall 62 accessible from one side, but inaccessible from an opposite side. In the illustrated embodiment, the thin wall is part of a tube. In other embodiments (not shown), the thin wall may be a ceiling or a wall, for example.

Figure 2:
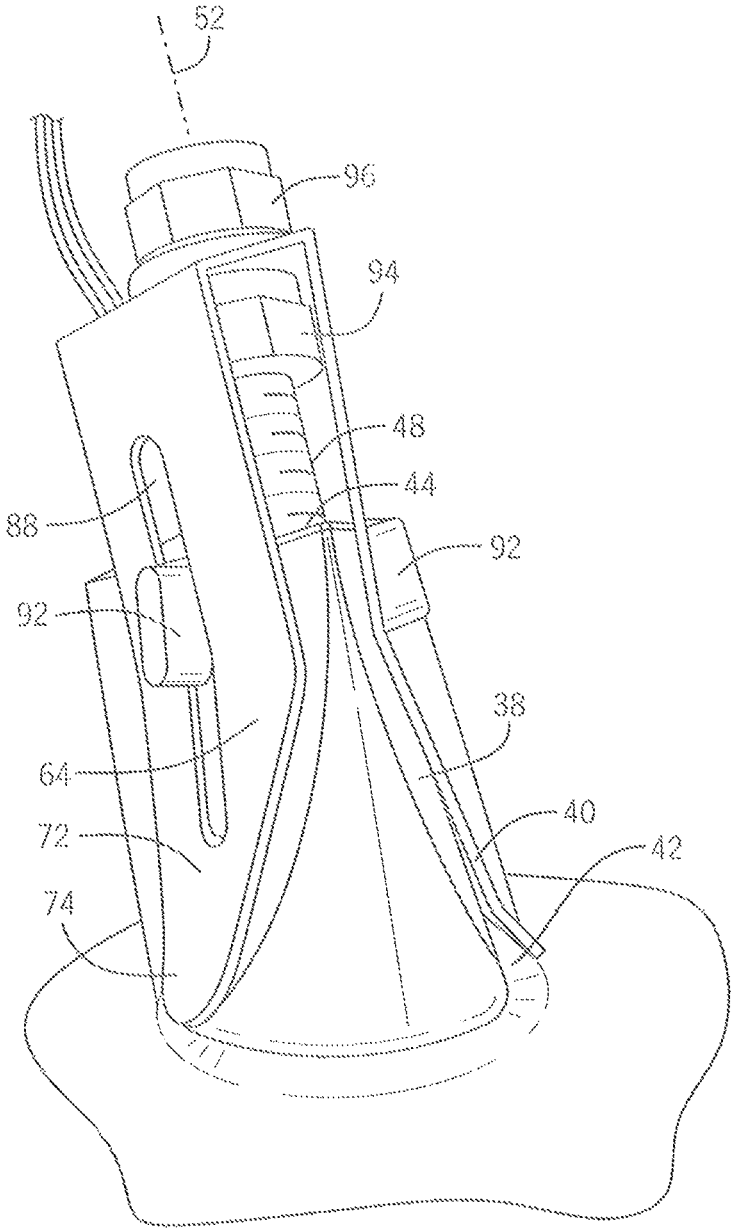
FIG. 2 is an end view of a cross section of the tube, showing the light assembly in the tube opening before lock pieces move out and away from the light's central axis, capturing the thin wall between the lock pieces and a flange on an end of the light.
Figure 3A:
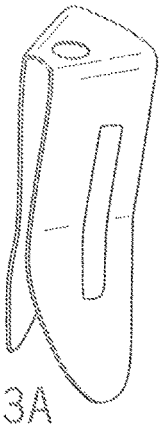
FIG. 3A is a perspective view of a U-shaped piece that forms the lock pieces, as described below.
Figure 3B:
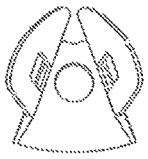
FIG. 3B is a front top view of the lock piece of FIG. 3A.
Figure 3D:
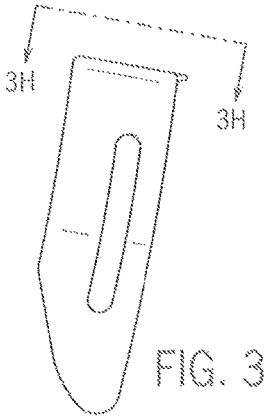
FIG. 3D is a side view of the lock piece of FIG. 3A.
Figure 3C:
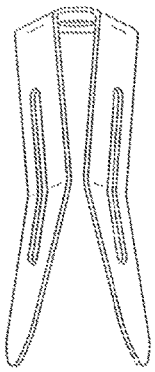
FIG. 3C is a front view of the lock piece of FIG. 3A.
Figure 3F:
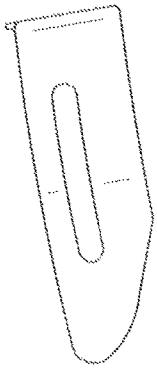
FIG. 3F is another side view of the lock piece of FIG. 3A.
Figure 3E:
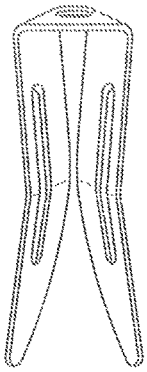
FIG. 3E is a perspective side view of the lock piece of FIG. 3A.
Figure 3G:
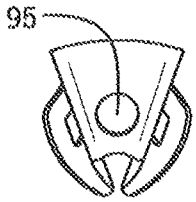
FIG. 3G is a rear top view of the lock piece of FIG. 3A.
Figure 3H:
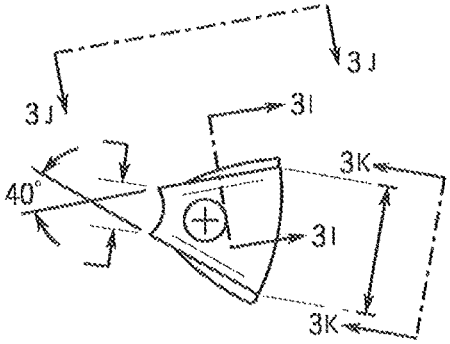
FIG. 3H is a top view taken along the line K-K of FIG. 3D.
Figure 3J:
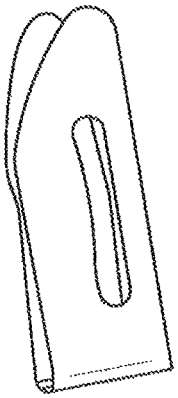
FIG. 3J is a cross sectional view taken along the line 3J-3J of FIG. 3H.
Figure 3K:
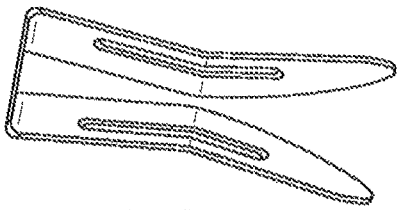
FIG. 3K is a side view taken along the line 3K-3K of FIG. 3H.
Figure 3I:
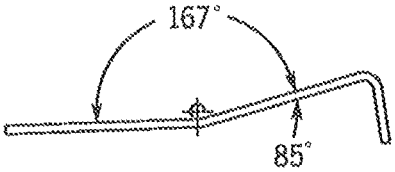
FIG. 3I is a side view taken along the line 3I-3I of FIG. 3H.
Figure 4:
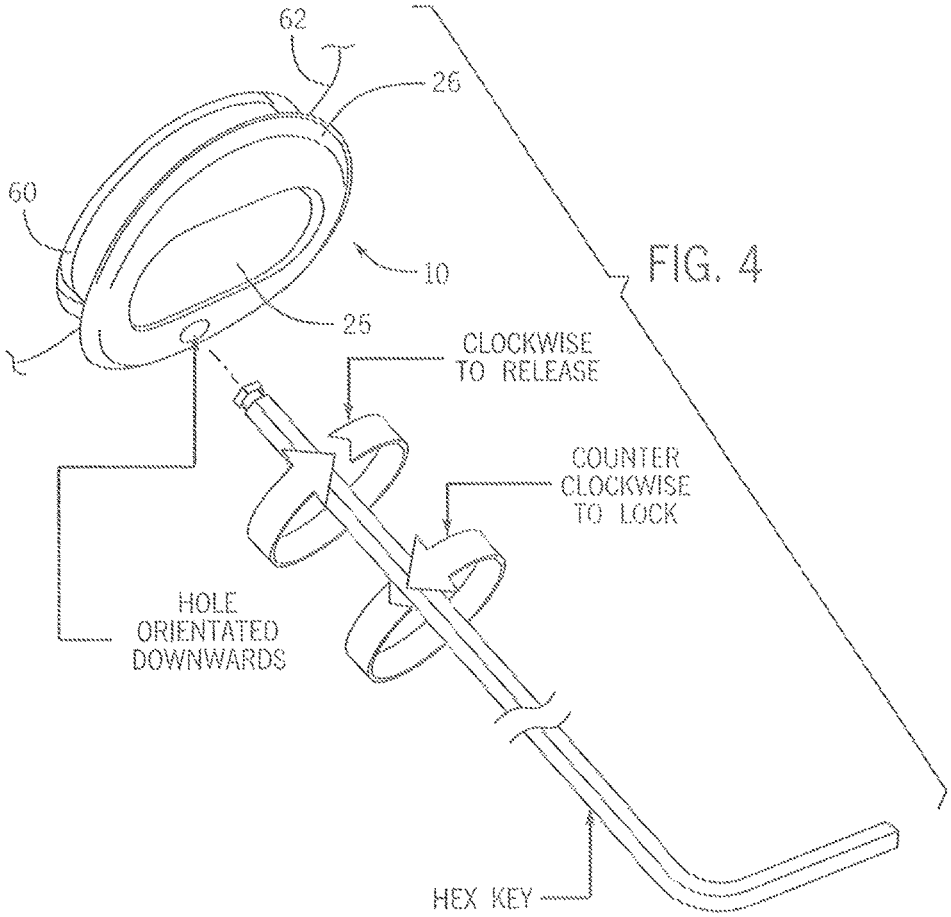
FIG. 4 is a schematic representation of how the light assembly is either secured in or removed from the tube (not shown).
Figure 5A:
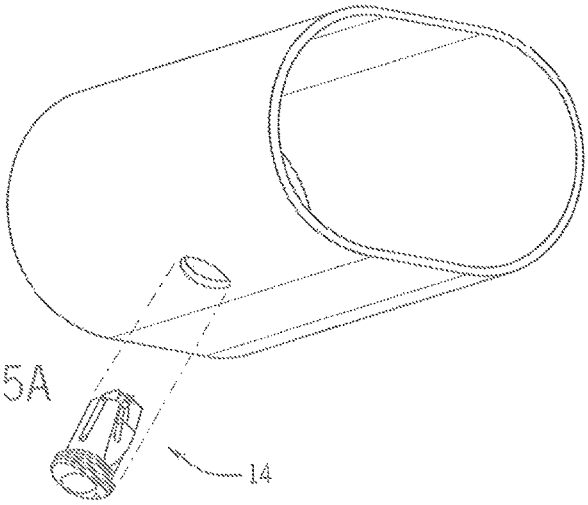
FIG. 5A is a bottom perspective view of a tube and a light assembly according to this disclosure.
Figure 5B:
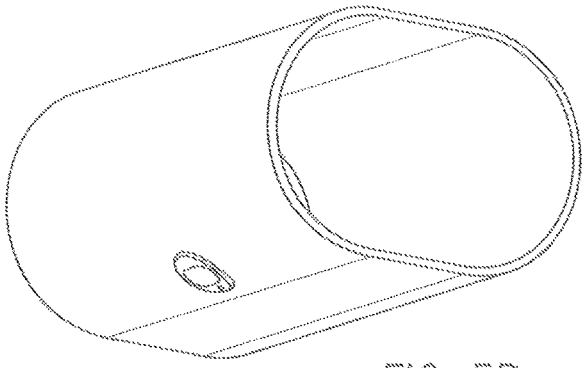
FIG. 5B is a bottom perspective view of the light assembly assembled with the tube of FIG. 5A.
Figure 5C:
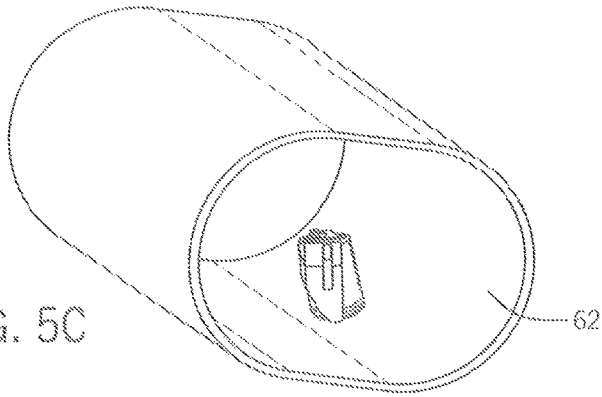
FIG. 5C is a side perspective view of the light assembly assembled with the tube of FIG. 5A.

As illustrated in FIGS. 1 and 2, the light assembly 10 includes a light 14, the light 14 including a body 16 having one end 18 and another end 22 having an outwardly extending flange 26, an elongated light central axis 30, and an outer surface 34. In the disclosed embodiment the light includes an LED 25, but in other embodiments, other means for illumination can be used. The light 14 includes a wire harness 27 for connecting the light to wiring inside of the tube 62. The outer surface 34 has a ramp 38 closer to the elongated light central axis 30 at the one end 18 of the body 16, the ramp 38 being further away from the elongated light central axis 30 near the other end 22.

The light assembly 10 also includes a lock piece 40 having an end 42, the lock piece 40 being positioned on the body 16 for movement along the ramp 38 away from the one end 18, so that the lock piece end 42 moves further away from the elongated light central axis 30 as the lock piece 40 moves along the ramp 38 and away from the one end 18. The body 16 also has a threaded opening 44, and the light assembly 10 further includes a like threaded stem 48 having an elongated stem axis 52. The stem 48 is received in the threaded opening 44 in the light 14 and is connected to the lock piece 40. Thus, as the threaded stem 48 rotates about the elongated stem axis 52 in the threaded opening 44, and the stem 48 moves along the elongated stem axis 52 away from the light one end 18, the stem 48 also moves the lock piece 40 away from the one end 18. As a result, the lock piece end 42 moves outward away from the light's central axis 30, trapping the thin wall 62 between the lock piece end 42 and the light flange 26.

Further, when the stem 48 rotates in an opposite direction in the threaded opening 44 about the stem's elongated axis 52, the stem 48 moves toward the light one end 18, the stem 48 moves the lock piece 40 towards the light one end 18, pulling the lock piece end 42 back (by virtue of the lock piece bias, as described below) towards the light central axis 30, allowing the light assembly 10 to once more pass through the thin wall opening 60.

In one embodiment, the light outer surface 34 has another ramp 64 opposite the one ramp 38. The other ramp 64 also is closer to the elongated light central axis 30 at the one end 18 of the light 14, and the other ramp 64 is further away from the elongated light central axis 30 near the other end 22. The light assembly 10 also includes another lock piece 72 having an end 74. The other lock piece 72 is positioned on the light 14 for movement along the other ramp 64 away from the one end 18, so that the other lock piece end 74 moves further out and away from the elongated light central axis 30 as the other lock piece 72 moves along the other ramp 64 away from the one end 18. The other lock piece 72 is also connected to the stem 48 so that, as the stem 48 rotates in the threaded opening 44 about the elongated stem axis 52, moving away from the light one end 18, the stem 48 moves the other lock piece 72 away from the one end 18.

Each of the lock pieces has a slot 88 along a mid-portion of the lock piece, and each ramp has a projection 92 which is received in the slot 18 for guiding the lock piece along the ramp.

The lock piece 40 and the other lock piece 72 are formed from two ends of a U-shaped piece of spring steel, the spring steel biasing the lock pieces toward the light 14, keeping the lock pieces against their respective ramps. One end of the stem 48 is connected to the U-shaped piece by having the stem 48 extend through an opening 95 in the portion of the U-shaped piece that connects the two lock pieces. Nuts 94 and 96 on either side of the U-shaped piece portion connect the stem 48 to the U-shaped piece.

The disclosed method comprises inserting the one end 18 of the light 14 into the thin wall opening 60, then using a hex key 63 inserted into an opening (not shown) in an end (not shown) of the threaded stem 48 to rotate the threaded stem 48 about its elongated axis 52.

Various other features of the disclosure are set forth in the following claims.

The invention claimed is:

1. A light assembly including a light having a body with a ramp and a threaded opening, the body having one end and another end having an outwardly extending flange, an elongated light central axis, and an outer surface having the ramp closer to the elongated light central axis at the one end of the light, and the ramp being further away from the elongated light central axis near the other end, and a lock piece having an end, the lock piece being positioned on the body for movement along the ramp away from the one end, so that the lock piece end moves further away from the elongated central axis as the lock piece moves along the ramp away from the one end, and the light assembly further including a like threaded stem having an elongated axis and received in the threaded opening in the light, the stem being connected to the lock piece so that, as the threaded stem rotates about its elongated axis in the threaded opening, moving away from the light one end, the stem moves the lock piece away from the one end.

2. A light assembly according to claim 1 wherein, when the stem rotates in an opposite direction in the threaded opening about the stem's elongated axis, moving toward the light one end, the stem moves the lock piece towards the one end.

3. A light assembly according to claim 1 wherein the light outer surface has another ramp opposite the one ramp, the other ramp also being closer to the elongated central axis at the one end of the light, and the other ramp being further away from the elongated central axis near the other end, and another lock piece having an end, the other lock piece being positioned on the light for movement along the other ramp away from the one end, so that the other lock piece end moves further away from the elongated central axis as the other lock piece moves along the other ramp away from the one end, the other lock piece also being connected to the stem so that, as the stein rotates in the threaded opening about its elongated axis, moving away from the light one end, the stem moves the other lock piece away from the one end.

4. A light assembly according to claim 1 wherein the lock piece has a slot along a mid-portion of the lock piece, and the ramp has a projection received in the slot for guiding the lock piece along the ramp.

5. A light assembly according to claim 1 wherein the lock piece and the other lock piece are formed from two ends of a U shaped piece of spring steel, the spring steel biasing the lock pieces toward the light, keeping the lock pieces against the ramp.

* * * * *